United States Patent [19]

Tanaka et al.

[11] 3,978,305

[45] Aug. 31, 1976

[54] MICROWAVE OVEN

[75] Inventors: Junzo Tanaka, Fujiidera; Tsuyoshi Takami, Nara; Chikao Nakano, Yamato Koriyama, all of Japan

[73] Assignee: Matsushita Electric Industrial Co., Ltd., Osaka, Japan

[22] Filed: May 19, 1975

[21] Appl. No.: 579,077

[30] Foreign Application Priority Data

Aug. 6, 1974 Japan ..... 49-94313[U]
May 20, 1974 Japan ..... 49-57070

[52] U.S. Cl. ..... 219/10.55 E; 116/129 L
[51] Int. Cl.[2] ..... H05B 9/06
[58] Field of Search ..... 219/10.55 E, 10.55 R, 219/10.55 B; 116/124.1 A, 124.1 R, 115, 133, 129 R, 129 H, 129 Q, 129 P, 129 L, 129 M

[56] References Cited

UNITED STATES PATENTS 3,848,105 11/1974 Mori ..... 219/10.55 E
3,889,091 6/1975 Ishikawa ..... 219/10.55 E

*Primary Examiner*—Arthur T. Grimley
*Attorney, Agent, or Firm*—Wenderoth, Lind & Ponack

[57] ABSTRACT

A microwave oven has an oven-defining housing structure having an electric lamp used to illuminate the interior of the oven-defining housing structure, that is, a heating chamber. The oven-defining housing structure has a control panel at the front thereof, which control panel includes one or more signaling windows or indicators to be illuminated, for example, one signaling window representing, when illuminated, that the high frequency wave generator is in position to generate a low radiating energy into the heating chamber and the other signaling window representing, when illuminated, that the high frequency wave generator is being operated. These signaling windows are respectively illuminated by portions of rays of light emitted by the oven lamp by means of light transmitters. Respective shutter mechanisms are provided for controlling passage of the light rays from the oven lamp towards the signaling windows so that the latter can be illuminated at required times.

12 Claims, 6 Drawing Figures

MICROWAVE OVEN

The present invention generally relates to a microwave oven or electronic oven and, more particularly, to an illumination device in the microwave oven for illuminating a display unit at the front control panel of the microwave oven housing structure.

A microwave oven wherein the output of a high frequency wave generator or magnetron can be adjustable to either high or low is now commercially available. Even this type of microwave oven has a display unit including, in addition to a signaling device which is, for example, energized only when the high frequency wave generator is operated to generate a high radiating energy, another signaling device which is energized when the high frequency wave generator is operated irrespective of the high and low state of output of said wave generator.

The first and second mentioned signaling devices heretofore used in the commercially available microwave oven comprise respectively different signaling lamps which are separate from an electric lamp used to illuminate the interior of the oven-defining structure, that is, the microwave oven housing structure.

In other words, in the commercially available microwave oven, a number of electric lamps, one for each item to be illuminated, are employed and, therefore, a relatively large space for installation of these lamps is required. The employment of the different electric lamps for the particular items to be illuminated involves numerous other disadvantages. By way of example, the wattage of the microwave oven increases and maintenance of the microwave oven is expensive in view of the fact that the electric lamps may be burnt out, or otherwise exhausted, one after another at different times with the consequent requirement of successive replacement of the burnt or exhausted lamp or lamps. In addition, since the employment of the different electric lamps require relatively complicated electric wiring within a limited space for installation, the manufacturing cost of the microwave oven tends to increase.

Accordingly, an essential object of the present invention is to provide an improved microwave oven wherein the electric lamp, which is used to illuminate the interior of the oven-defining structure, is concurrently used to illuminate the display unit having one or more signaling windows accessible to the eye of the user or operator of the microwave oven, thereby substantially eliminating the numerous disadvantages inherent in the conventional microwave oven.

Another important object of the present invention is to provide an improved microwave oven of the type referred to above, wherein means for guiding rays of light from the only and the same electric lamp, used to illuminate the interior of the oven-defining structure, to the signaling windows is provided together with means for controlling passage of the light rays from the electric lamp to the respective signaling windows.

A further object of the present invention is to provide an improved microwave oven of the type referred to above, which does not require complicated wiring for the illumination device and, therefore, can easily and readily be manufactured with no substantial increase in the manufacturing cost.

In accomplishing these objects, according to one preferred embodiment of the present invention herein disclosed for the purpose of illustration, the display unit at the front of the oven-defining structure for the microwave oven is described as having two signaling windows in addition to a cooking time display window; one signaling window being adapted to, when illuminated, show that the high frequency wave generator is being operated and the other signaling window being adapted to, when equally illuminated, to show that the high frequency wave generator has been set to generate a low output, that is, a high microwave radiating energy.

Since the electric lamp used to illuminate the interior of the oven-defining structure is turned on upon closure of an electric power supply switch which is usually effected by turning a timer setting shaft operatively coupled with said power supply switch through an electric self-energizing circuit, control means is provided for controlling passage of rays of light from said electric lamp towards said signaling windows so that the latter can respectively be illuminated at required times. The passage of the rays of light from the electric lamp towards the signaling windows according to the present invention takes place through light transmitters, each in the form of a bundle of optical fibers, substantially extending from one side of the electric lamp towards the first mentioned signaling window and from the other side of said electric lamp towards the second mentioned signaling window.

Accordingly, the control means comprises different shutter mechanisms, one of which can be brought into an operative position to permit passage of light from the electric lamp towards the first mentioned signaling window in response to switch-on of the cooking start switch. The other shutter mechanism can be brought into operative position to interrupt passage of light from the electric lamp towards the second mentioned signaling window in response to switch-over from one mode of operation, i.e., low output state, of the high frequency wave generator to another mode of operation, i.e., high output state, of the same high frequency wave generator.

These and other objects and features of the present invention will become apparent from the following description taken in conjunction with a preferred embodiment thereof with reference to the accompanying drawings, in which.

Before the description of the present invention proceeds, it should be noted that like parts are designated by like reference numerals throughout the accompanying drawings.

Figure 1:
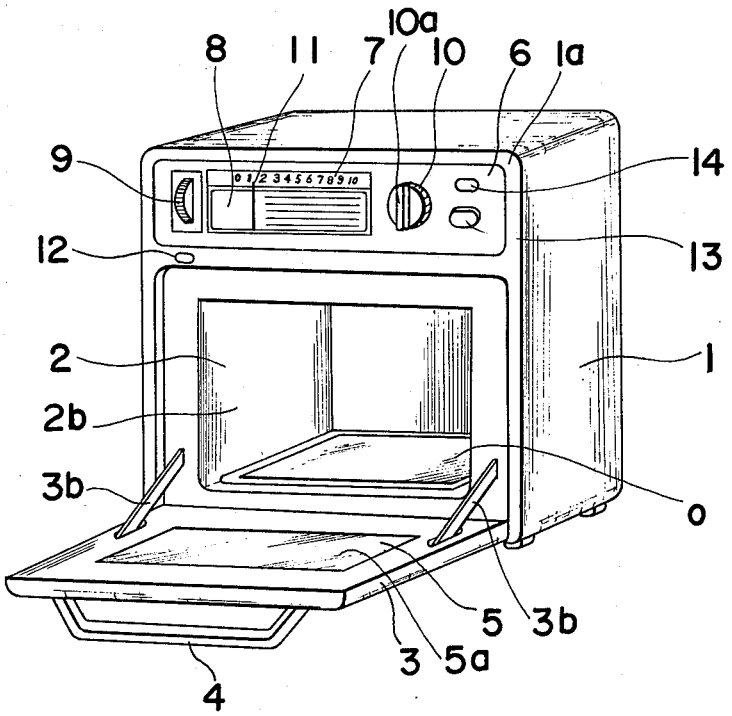
FIG. 1 is a perspective view of a microwave oven according to one embodiment of the present invention with a hingedly supported door opened.
Figure 2:
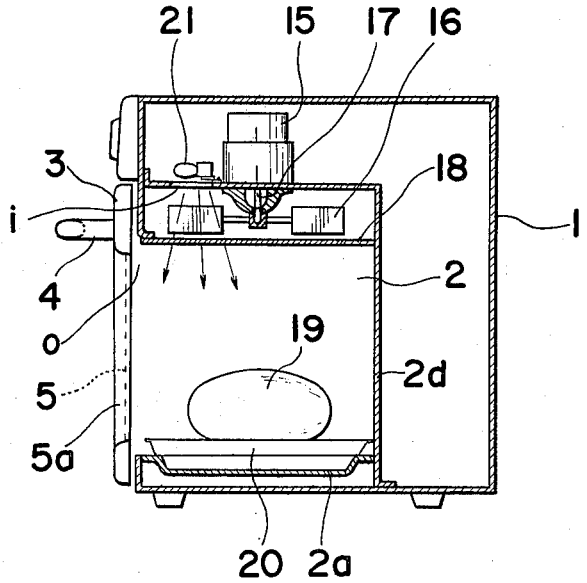
FIG. 2 is a side sectional view of the microwave oven of FIG. 1, with the door closed.

Referring first to FIGS. 1 and 2, there is shown a microwave oven of the invention which includes an outer casing 1 of cubic box-like configuration open at the front side thereof. The outer casing 1 has a double-walled structure and comprises inner walls which are suitably made of steel plate or similar material and define a heating chamber 2, these inner walls including a horizontal base plate 2*a*, vertical side walls 2*b*, a top wall 2*c* and a rear wall 2*d*, and thus defining an access opening O at the front of the oven. Outer surfaces of these walls 2*a*, 2*b*, 2*c* and 2*d* are spaced from the corresponding walls of the outer casing 1 so as to provide spaces therebetween. The outer casing 1 further includes an outside front wall portion 1*a* immediately above the opening O. On the front wall portion 1*a*, there is mounted a control panel 6, carrying a timer 10, a timer scale plate 7 with a pointer 11, a heating time setting scale 8 arranged adjacent to the timer scale plate 7, an adjusting wheel 9 for the heating time setting scale 8, a cooking start button 13 and a cooking indicator 14.

The scale 8 is for setting heating time suitable for particular kind and quantities of food, and is adapted to indicate, on the scale, the article of food to be cooked by turning the adjusting wheel 9, with which indication the pointer 11 of the timer scale 7 is aligned through rotation of the knob 10*a* of the timer 10 for optimum cooking. The adjusting wheel 9 also serves for changing over of high frequency outputs and is adapted to, upon rotation thereof, illuminate a high frequency output indicator 12 disposed on the front wall portion 1*a* below the wheel 9 especially during low output periods when frozen food or an egg dish is to be cooked. Similarly, the start button 13 to actuate a cooking switch mentioned later for high frequency output generation also serves for actuating the cooking indicator 14 which shows the oscillating condition of the high frequency output generator. It is to be noted that the high frequency energy to be employed in the oven of the above described type for heating objects to be cooked is normally on the order of 2,450 mHz or thereabout.

The microwave oven further includes a door 3 provided with a handle 4 adjacent to one edge thereof remote from the hinge through which the door 3 is supported at the lower edge thereof to the lower front edge of the casing 1 in a position corresponding to the access opening O for pivotal upward and downward movement so as to selectively open and close the access opening O. More specifically, the door 3 has a rectangular opening 5 in the central portion thereof, in which opening 5 a transparent plate member and a shielding plate or the like (not shown) for shielding the microwaves are closely fitted to form an observation window 5*a* in the door 3 for the observation of an object 19 to be cooked which is placed within the heating chamber. The main casing 1 further includes an interior portion which provides sliding accommodation for a pair of door arms 3*b*, each of which is attached to a lower side portion of the door 3 and passes through a portion between the side wall of the casing and the corresponding side wall 2*b* of the heating chamber 2.

Referring particularly to FIG. 2, in the space defined by the top wall of the casing 1 and the corresponding top wall 2*c* of the heating chamber 2, there are disposed generally in the central portion of the wall 2*c*, a magnetron assembly 15 for radiating high frequency energy into the heating chamber 2, a stirrer fan 16 which is rotatably supported by a shaft 17 extending into the heating chamber 2 and which is adapted to rotate for stirring the high frequency energy in the chamber 2 by the air flow caused by blower means (not shown) for cooling the magnetron assembly 15. Immediately below the stirrer fan 16, a partition plate 18 is disposed in spaced relation to the fan 16 and in a direction parallel to the top wall 2*c*, which partition plate 18 is supported at opposite edges thereof on a lower edge of the front wall 1*a* of the casing and the rear wall 2*d* of the heating chamber 2, respectively. The horizontal base plate 2*a* of the chamber 2 is provided with a concave portion in the central part thereof and suitably connected to a front upwardly bent edge of the bottom plate of the casing 1 and the rear wall 2*d* of the heating chamber with a space left between the bottom plate of the casing 1 and the base plate 2*a*, on which base plate 2*a* the object 19 to be heated, which is mounted on a vessel 20 of a non-metallic material, is placed. On the top wall 2*c* of the chamber 2, an electric lamp 21 is disposed adjacent to the magnetron 15 for illuminating the heating chamber 2 through an opening *i* suitably formed in the wall 2*c*.

Figure 6:
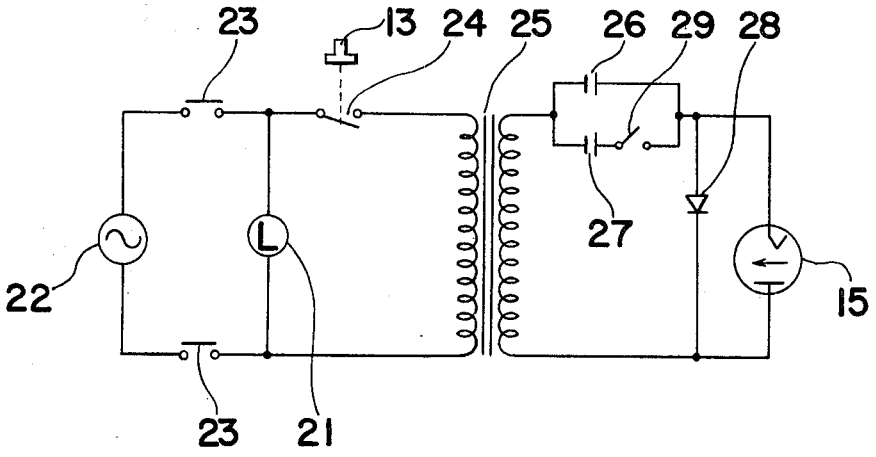
FIG. 6 is an electric circuit diagram of the microwave oven of FIG. 1.

Referring now to FIG. 6, there is shown an electric circuit diagram for the microwave oven according to the present invention, in which the oven lamp 21 is connected in series with an A.C. power source 22 through contacts of a time switch 23. Connected in parallel to the lamp 21 is a primary winding of a high voltage transformer 25 through a cooking start switch 24. The magnetron 15 and a diode 28 are connected in parallel to each other and in series with a secondary winding of the transformer 25 with capacitors 26 and 27, which are connected in parallel with each other, being inserted in one side of said secondary winding between the diode 28 and said secondary winding. Between one end of the capacitor 27 and the diode 28, there is inserted a change-over switch 29.

With this arrangement, the timer 10 is set to hold time switch 23 on for a certain time and then the start button 13 is depressed, the start switch 24 becomes actuated to energize the lamp 21, and if the cooking switch is subsequently turned on, a half-wave voltage doubler rectification circuit is formed by the high voltage transformer 25, the capacitor 26, and the capacitor 27 and the diode 28 for operating the magnetron 15. Upon closure of the contacts of the switch-over switch 29 by operation of adjusting wheel 9, the capacitance of the capacitors 26 and 27 is increased with consequent increase of the high frequency output, while when the contacts of the switch 29 are opened, only the capacitor 26 functions and consequently the high frequency output decreases. As is seen from the above description, the microwave oven of the invention carries out cooking at the optimum condition by selectively turning the switch 29 on and off depending on the kind of the object 19 to be cooked.

Figure 3:
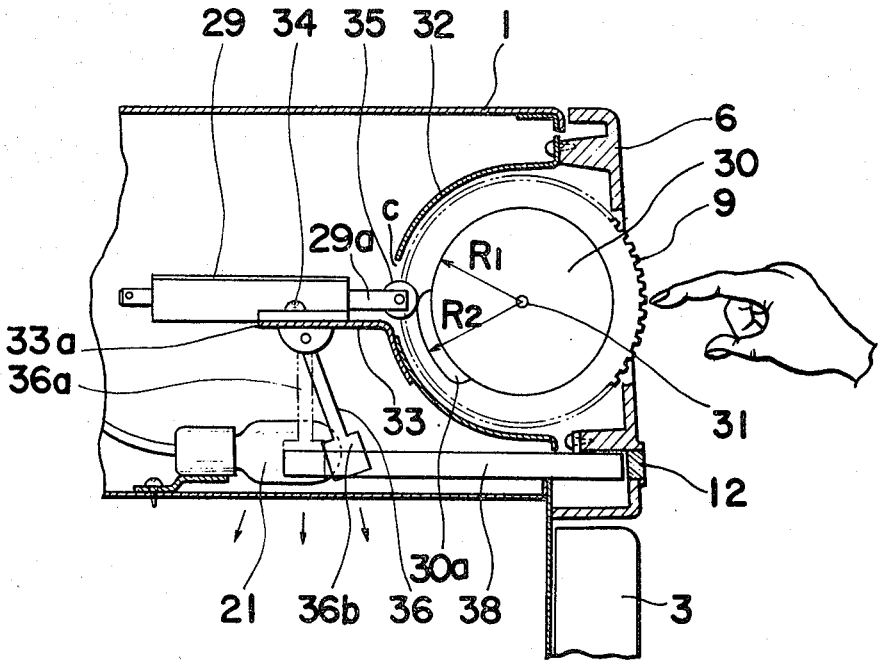
FIG. 3 is a side sectional view, on an enlarged scale, of a portion of the microwave oven, showing construction of an adjusting wheel and its associated mechanisms.

Referring back to FIG. 3, the adjusting wheel 9 is rotatably supported on a shaft 31 suitably journalled to frames (not shown) of the microwave oven and is fixedly attached to or integrally formed with a cam plate 30 supported on the same shaft 31. The cam plate 30 having a radius $R_1$ is provided at an outer periphery thereof with a projecting portion 30*a* having a radius $R_2$ about the axis of the shaft 31. Inner half of the outer periphery of the plate 30 is covered with a pair of cover plates 32 suitably secured to the control panel 6 and frames (not shown) of the casing 1, the facing inner edges of the cover plates 32 being spaced from each other to define an opening C therebetween. A shaped connector 33 is suitably secured at one edge thereof to the front edge of the lower one of the cover plates 32, while the other edge portion 33*a* of the connector 33 extends into the oven interior in a direction parallel to the top wall 2*c* of the heating chamber 2.

On the upper surface of the edge portion 33*a* of the connector 33, there is secured the change-over switch 29 by fastening screws 34, which change-over switch 29 is provided with an actuating rod 29*a* slidably movably incorporated in one end of the switch 29 facing the cam plate 30. At the extreme end of the rod 29*a*, a small roller 35 is rotatably mounted, which troller 35 is suitably urged into contact with the outer periphery of the cam plate 30 while a shutter plate 36 is pivotally connected to the lower side of the switch 29 for pivotal movement between positions 36*a* and 36*b* as the rod 29*a* reciprocates. When the roller 35 is in contact with the outer periphery of the cam plate 30 having the radius $R_1$, the switch 29 is turned on with the shutter plate 36 located in the position 36*a*, while when the roller 35 contacts the outer periphery of the cam plate 30 having the radius $R_2$, the roller 35 and consequently the rod 29*a* is pressed against the projection 30*a* with the switch 29 turned off and also with the shutter plate 36 displaced to the position 36*b*.

Figure 4:
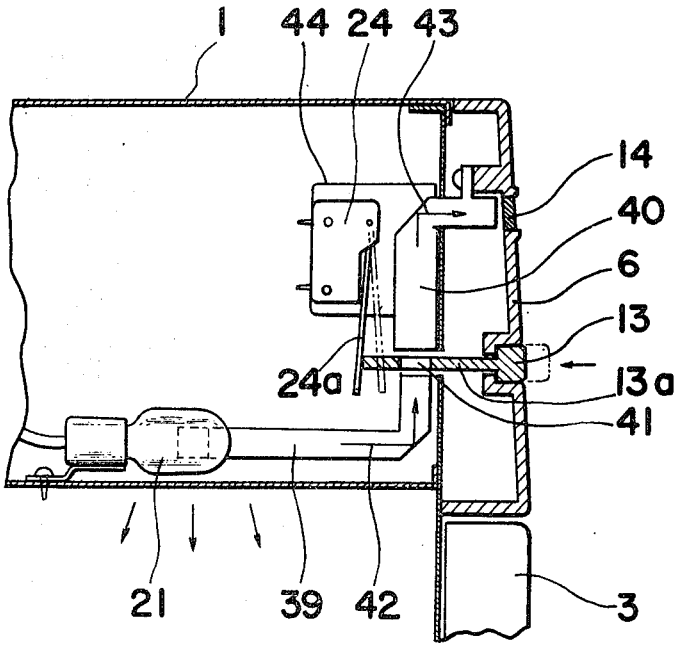
FIG. 4 is a similar view to FIG. 3, showing arrangements of a cooking start push button and a cooking indicator employed in the microwave oven of FIG 1.
Figure 5:
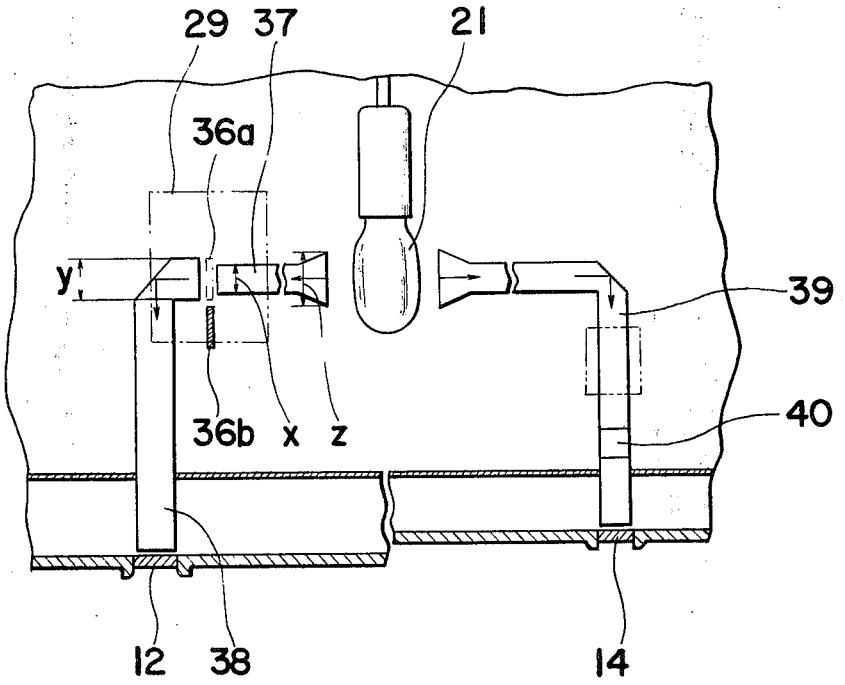
FIG. 5 is a schematic top sectional view, on an enlarged scale, showing arrangements of an illumination system in the microwave oven of FIG. 1.

Referring to FIGS. 4 and 5, between the oven lamp 21 and the high frequency indicator 12, there are provided known light transmitters 37 and 38 each composed of a bundle of optical fibers made, for example, of synthetic resin such as acrylics, or glass, for transmitting light rays from the lamp 21 to the indicator 12 with one end of said transmitter 37 spaced a certain distance from the corresponding end of the transmitter 38. When the shutter plate 36 is in the position 36*a* between the transmitters 37 and 38 shown by the dotted line in FIG. 5, light rays from the lamp 21 are prevented from being transmitted to the indicator 12 through the transmitter 38, while when the shutter plate 36 is displaced to the position 36*b* shown by the solid line in FIG. 5, the light rays from the lamp 21 are directly transmitted to the indicator 12 through the transmitters 37 and 38, the shutter plate 36 thus controlling the passage of light rays through the transmitters 37 and 38. In other words, when the high frequency output is high with the change-over switch 29 turned on through revolving of the adjusting wheel 9, the shutter plate 36 is in the position 36*a* for shielding the light rays from the lamp 21 to the high frequency output indicator 12. On the contrary, when the high frequency output is low with the change-over switch 29 turned off, the plate 36 is in the position 36*b* for permitting light rays to be transmitted to the indicator 12 from the lamp 21 through the transmitters 37 and 38 for illuminating the indicator 12.

Referring particularly to FIG. 4, there are also provided known light transmitters 39 and 40 of the kind described above between the oven lamp 21 and the cooking indicator 14 with a small space present between facing ends of the transmitters 39 and 40. The starting button 13 has one end formed into a plate portion 13*a* which extends into the oven interior through the space between the transmitters 39 and 40 and has an opening 41 therein corresponding the facing ends of the transmitters 39 and 40. The cooking start switch 24 is suitably secured by a plate 44 to a frame (not shown) of the oven casing 1 in a position immediately behind the transmitter 40 in the oven interior and is adapted to be actuated when the movable contact arm 24*a* thereof is pressed by the edge of the plate portion 13*a* of the start button 13. In other words, when the start button 13 is in a position shown by the chain line in FIG. 4, light rays from the lamp 21 are shielded by the plate portion 13*a* with the contact arm 24*a* of the switch 24 being in a position shown by the chain line in FIG. 4, while when the start button 13 is depressed in the direction shown by the arrow into the oven interior, the opening 41 of the plate portion 13*a* thereof is brought to a position in alignment with the facing ends of the transmitters 39 and 40 with the movable contact arm 24*a* of the switch 24 displaced to a position, shown by the solid line in FIG. 4, for actuation of the switch 24. As described above, when the start button 13 is depressed as shown by the solid line in FIG. 4, the light rays from the lamp 21 are directed through the transmitters 39 and 40, as indicated by the arrows 42 and 43 in FIG. 4, respectively, for illuminating the cooking indicator 14.

It should be noted that, as shown in FIG. 5, the width *y* or diameter of the light transmitter 38 at the light receiving side thereof adjacent to the transmitter 37 is larger than the width *x* of the corresponding end of the transmitter 37 at the light emerging side, which arrangement is particularly advantageous in reducing the loss of light conduction with consequent perfect utilization of light rays from the lamp 21, even when some deviations may exist in relative positions of the transmitters 37 and 38 in the assembling of these during manufacturing.

It should be noted that the sectional area of the transmitter 37 at the end *z* thereof adjacent to the lamp 21 is made larger than the sectional area of its other end *x* facing the transmitter 38 as is seen from FIG. 5 for optimum collection of the light rays emitted by the lamp 21.

Although the present invention has been fully described in conjunction with the preferred embodiment thereof, it should be noted that various changes and modifications are apparent to those skilled in the art. Such changes and modifications are to be understood as included within the scope of the present invention unless they depart therefrom.

What is claimed is:

1. A microwave oven which comprises:

an oven-defining housing structure having a heating chamber therein and having a hingedly supported door for selectively opening and closing an access opening leading into said heating chamber;

a high frequency wave generator for, when energized, generating a high frequency wave directed into said heating chamber;

ouput control means for the high frequency wave generator;

a cooking switch mechanism for, when operated, completing a circuit between a source of electric power and said high frequency wave generator;

a source of illumination light;

display means for, when illuminated, displaying the operating condition of the microwave oven;

light guide means for optically connecting said illumination light source to said display means; and means for controlling the amount of light transmitted from said illumination light source to said display means.

2. A microwave oven as claimed in claim 1, wherein said display means comprises a plurality of display windows.

3. A microwave oven as claimed in claim 1, wherein said controlling means is operatively associated with said output control means for causing said display means to display the state of the output of said high frequency wave generator.

4. A microwave oven as claimed in claim 1, wherein said controlling means is operatively associated with said cooking switch mechanism for causing said display means to display the state of operation of cooking performed by the microwave oven.

5. A microwave oven as claimed in claim 1, wherein said light guide means comprises first and second elongated light transmitters, one end of said first light transmitter having a cross sectional area larger than that of one of the opposite ends of said second light transmitter which is adjacent said one end of said first light transmitter, the light from said illumination light source being adapted to travel from said one of said opposite ends of said second light transmitter towards said one end of said first light transmitter.

6. A microwave oven as claimed in claim 1, wherein said light guide means comprises at least one elongated light transmitter, one of the opposite ends of said light transmitter being situated adjacent said light source and having a larger cross sectional area than that of the remaining portion of said light transmitter.

7. A microwave oven which comprises:

an oven-defining housing structure including an outer casing and an inner casing within and in spaced relation to said outer casing, said inner casing defining therein a heating chamber, said oven-defining housing structure having a hingedly supported door for selectively opening and closing an access opening leading into said heating chamber and an illumination lamp for, when energized, illuminating said heating chamber;

a high frequency wave generator for, when energized, generating microwaves directed into said heating chamber;

a first electrical switch means for, when brought into operative position, completing a power supply circuit for said high frequency wave generator to energize the latter;

a timer device for being set to any desired operating period, said high frequency wave generator being operatively coupled to said timer device and energized during said operation period;

display means for, when illuminated, visually presenting information that said high frequency wave generator is being energized;

light guide means for optically connecting said illumination lamp to said display means for illuminating said display means with a portion of light from said lamp transmitted therethrough; and shutter means supported in position to interrupt passage of said portion of light from said lamp towards said display means through said light guide means when said first switch means is not operated, said shutter means being operatively associated with said first switch means such that, when said first switch means is brought into said operative position, said shutter means is held in position to permit said passage of said portion of light towards said display means to illuminate the latter.

8. A microwave oven as claimed in claim 7, wherein said light guide means comprises first and second elongated light transmitters, each of said transmitters being composed of a bundle of optical fibers, said first transmitter having one end situated adjacent said illumination lamp and the other end situated adjacent said shutter means and said second transmitter having one end situated adjacent said shutter means in alignment with said other end of said first transmitter and the other end situated adjacent said display means.

9. A microwave oven as claimed in claim 8, wherein said shutter means comprises an elongated member operatively coupled to said first switch means and having a perforation therein, said elongated member movable between first and second positions, said elongated member in said first position positioning said perforation clear of the passage of the portion light from said lamp towards said display means, said elongated member in said second position positioning said perforation in alignment with said passage of the portion of light from said lamp towards said display means.

10. A microwave oven as claimed in claim 7, further comprising a circuit means for, when completed, energizing said high frequency wave generator to generate microwaves at a lower ouput than that generated during opening of said circuit means and a second electrical switch means for selectively opening and completing said said circuit means, another display means for, when illuminated, visually presenting information that said second switch means is held in position to complete said circuit means, another light guide means for optically connecting said illumination lamp to said another display means for illuminating said another display means with another portion of light from said lamp transmitted through said another light guide means, and another shutter means supported in position to interrupt passage of said another portion of light from said lamp towards said another display means through said another light guide means when said second switch means is held in position to open said circuit means, said another shutter means being operatively associated with said second switch means such that, when said second switch means is held in position to complete said circuit means, said another shutter means permit said passage of said another portion of light from said lamp towards said display means to illuminate the latter.

11. A microwave oven as claimed in claim 10, wherein said light guide means comprises first and second elongated light transmitters, each of said transmitters being composed of a bundle of optical fibers, said first transmitter having one end situated adjacent said illumination lamp and the other end situated adjacent said shutter means and said second transmitter having one end situated adjacent said shutter means in alignment with said other end of said first transmitter and the other end situated adjacent said display means, said another light guide means comprises third and fourth elongated light transmitters of the same construction as said first and second transmitters, said third transmitter having one end situated adjacent said illumination lamp and the other end situated adjacent said another shutter means and said fourth transmitter having one end situated adjacent said another shutter means in alignment with said other end of said third transmitter and the other end situated adjacent said another display means.

12. A microwave oven as claimed in claim 11, wherein said shutter means comprises a first elongated member operatively coupled to said first switch means and having a perforation therein, said first elongated member being movable between first and second positions, said elongated member in said first position positioning said perforation in alignment with said passage of the portion of light from said lamp towards said display means, and said another shutter means comprises a second elongated member operatively coupled to said second switch means for pivotal movement between engaged and disengaged position in response to opening and closing of said second switch means, respectively, said elongated member in said engaged position interrupting the passage of the another portion of light from said lamp towards said another display means, said elongated member in said disengaged position permitting said passage of the another portion of light from said lamp towards said another display means.

* * * * *